US005355026A

United States Patent [19]

Scofield

[11] Patent Number: 5,355,026

[45] Date of Patent: Oct. 11, 1994

[54] WIRE-SENSORED RESIDENTIAL RANGE HOOD FIRE EXTINGUISHER SYSTEM

[75] Inventor: William A. Scofield, Clifton, N.J.

[73] Assignee: Pem All Fire Extinguisher Corporation, Cranford, N.J.

[21] Appl. No.: 17,659

[22] Filed: Feb. 12, 1993

Related U.S. Application Data

[62] Division of Ser. No. 691,316, Apr. 25, 1991, Pat. No. 5,186,260.

[51] Int. Cl.[5] ..... A62C 35/00

[52] U.S. Cl. ..... 307/117; 169/61; 169/65

[58] Field of Search ..... 337/414, 415, 416, 417; 169/26, 61, 65, DIG. 3; 307/112, 116, 117; 219/212, 412, 413, 414, 505

[56] References Cited

U.S. PATENT DOCUMENTS

| | | | |
|---|---|---|---|
| 2,030,468 | 2/1936 | Rahlmann | 169/26 |
| 3,406,384 | 10/1968 | Hartman et al. | 337/414 |
| 3,653,443 | 4/1972 | Dockery | 61/61 |
| 3,824,374 | 7/1974 | Mayher | 169/65 |
| 4,157,526 | 6/1979 | Davies | 337/415 |
| 4,813,487 | 3/1989 | Mikulec et al. | 169/26 |
| 4,830,116 | 5/1989 | Walden et al. | 169/65 |
| 4,834,188 | 5/1989 | Silverman | 169/65 |
| 5,186,260 | 2/1993 | Scofield | 169/65 |
| 5,207,276 | 5/1993 | Scofield | 169/61 |

*Primary Examiner*—Jeffrey A. Gaffin
*Attorney, Agent, or Firm*—Rohm & Monsanto

[57] ABSTRACT

A range hood positioned above a cooking range employs a continuous heat sensor system which includes twisted wires which are separated from one another by an insulator which is formed of a material which melts at a predetermined temperature. The wires carry a supervisory current which also flows through an actuator, which may be an electrified system for cutting a tension wire. An indicator lamp, such as an LED, which may have a series resistor associated therewith, limits the current through the actuator to a level below the activation threshold of the actuator. Upon melting of the insulator, such as by the presence of a thermal hazard, a substantially short-circuit condition is produced which bypasses the current-controlling indicator LED, thereby applying an increased voltage across the actuator, as well as the current therethrough, to effect actuation of the actuator, whereby the actuator cuts the tension wire, permitting an actuation lever to be mover, and thereby causing a fire suppressant fluid to be discharged from a supply tank. Nozzles under the range hood direct the fire suppressant fluid, as desired.

8 Claims, 2 Drawing Sheets

WIRE-SENSORED RESIDENTIAL RANGE HOOD FIRE EXTINGUISHER SYSTEM

This is a division, of application Ser. No. 07/691,316 filed Apr. 25, 1991, U.S. Pat. No. 5,186,260.

BACKGROUND OF THE INVENTION

This invention relates generally to fire extinguisher systems, and more particularly, to a fire extinguisher system which is deployed as a hood over a range top, and which can determine the presence of a fire continuously along a predetermined path so as not to be limited to discrete sensing zones.

For over three decades, various arrangements of range hood fire protection systems have been employed in commercial and residential environments. Generally, these known systems are characterized by the application of a tensile force on a cable which holds a fire extinguisher discharge valve in a closed position against a force applied by a resilient element, such as a spring, which would tend to open the discharge valve. In these known systems, the cable is segmented and provided with fusible links connecting the various segments to one another. Additionally, cable is trained within the hood along a plurality of cable supports, whereby the fusible links are advantageously disposed at strategic locations, such as directly over a burner of the range top.

In the event of a fire, the heat which builds up under the hood will melt the fusible link so as to release the tension on the segmented cable. Such release of the tension permits the valve to be urged into the open position, by operation of the resilient biasing element.

There are, of course, a variety of problems associated with conventional fusible link systems. One major problem is the great complexity and difficulty associated with installing one of these known systems. During installation, the cable segments must be cut to precise lengths, or otherwise the fusible links will not be located in the appropriate regions. This, of course, is essential to a proper installation since mislocation of one or more of the fusible links will result in a fire hazard. In addition, the apparatus must be configured so that there is a sufficient length of cable between each fusible link and its nearest cable support, so that, upon the release of the cable at the fusible link, there is a sufficient length of cable before every cable support such that the discharged valve can be release. In other words, placement of a fusible link too close to the cable support will cause S-hooks or cable ties to bind at the cable support before the discharge valve has been moved sufficiently to enter a fully open state. Clearly, fusible link systems require great skill in their installation.

A still further problem which is associated with the installation of fusible link fire extinguisher systems is that, particularly in installations where the chemical tank is located remotely, possibly in another room, the cable must be trained along and through walls, and steps must be taken to ensure that the cable does not bind anywhere therealong. Of course, throughout its traverse, the cable must provide the tensile force which is required to prevent the biasing member from urging the discharge valve into the open position. Of course, if the cable binds anywhere along its path, the discharge valve can be retained in the closed position, notwithstanding that one or more of the fusible elements has melted. The results, of course, could be disastrous.

Another problem with fusible link systems is that they are not readily adaptable to changes in the configuration of the burners of the range top, without undergoing essentially a complete cable reinstallation process. More specifically, if it is desired to change the specific location of the region desired to be protected from a fire hazard under the protective hood, it is necessary in conventional fusible link systems that the entire fusible link and cable system be removed and resized so that the fusible links can be relocated. Of course, if it is necessary to protect an area which was not traversed over by the cable, significant modifications, such as the inclusion of new cable supports, will be required. Such cable supports must be structurally quite sound as they are generally required to bear the tensile force in the cable.

It is, therefore, an object of this invention to provide a simple and reliable residential range hood fire extinguisher system which can easily be installed without requiring extensive experience or expertise.

It is another object of this invention to provide a range hood fire extinguisher system which affords heat responsive sensing over a continuous predetermined region.

It is also an object of this invention to provide a fire extinguisher system which can be restored operationally within a short period of time after being triggered.

It is a further object of this invention to provide a fire extinguisher system which can easily trigger discharge of an extinguisher material from a remote location without the need to extend lengthy cables under tension.

It is additionally an object of this invention to provide a range hood fire protection system which can easily be reconfigured, as desire.

It is a yet further object of this invention to provide a fire extinguisher system which provides a visual indication of the ready state.

It is also another object of this invention to provide a range hood fire extinguisher system which does not require the complicated mechanical support arrangements provided for segment cable and fusible link systems.

It is yet an additional object of this invention to provide a range hood fire extinguisher system which is easy to clean.

It is still another object of this invention to provide a range hood fire extinguisher system which is easy to maintain and test for proper operation, and does not have associated with it the hazards of a tensioned cable.

It is a yet further object of this invention to provide a range hood fire extinguisher system which is easily adapted for different fire hazard temperatures.

It is also a further object of this invention to provide a simple and inexpensive range hood fire extinguisher system which does not require the strong cable supports of known arrangements.

SUMMARY OF THE INVENTION

The foregoing and other objects are achieved by this invention which provides a systems for extinguishing a fire which may occur within a protected region. In accordance with the invention, the system is provided with a hood which is arranged to overlie the protected region. Preferably, the hood has a top wall, first and second side walls, and a front wall, which are not necessarily precisely distinguishable from one another, as would be the case in embodiments which are curved and stylized. There is provided a supply coupling for connecting a supply of a fire suppressant material to a nozzle which is arranged to direct the fire suppressant material toward the protected region when the apparatus is activated. Further in accordance with the invention, first and second conductors are provided for carrying a small supervisory electrical current. The first and second conductors are separated by a conductor separator which has a predetermined heat response characteristic. The conductor separator maintains the first and second conductors electrically insulated from one another when the temperature within the protected region is below a predetermined temperature. However, when the predetermined temperature is exceeded, the electrical conductors are brought into electrical communication with one another to complete an electrical circuit with a low, or substantially short circuit, electrical impedance across the first and second conductors, and a corresponding increase in the magnitude of the supervisory electrical current. The increase in the supervisory electrical current is sufficient to cause a system for discharging a fire suppressant material to be activated.

In accordance with one embodiment of the invention, the inventive system is provided with an electrical coupling terminal for coupling across the first and second conductors and electrical device through which the supervisory current is propagated. The electrical device has an electrical impedance characteristic which is substantially greater in value than the very low impedance which results when the conductors are brought into communication with one another. The electrical device may be in the form of a light producing element, such as a photodiode which produces a visible indication responsive to the supervisory electrical current.

In a further embodiment of the invention, at least one of the Conductors is covered by an electrically insulating sleeve which is arranged to surround at least a portion of the conductor. The electrically insulating sleeve is formed of a material which melts when the predetermined current is exceeded. More specifically, the conductors are arranged on either side of the electrically insulating material, illustratively by wrapping one conductor around the other with the insulator therebetween, such that when the heat of the fire hazard causes the temperature to exceed a predetermined value, the insulating material melts away permitting the electrical communication between the conductors and the corresponding increase in the supervisory electrical current.

The aforementioned system is, in certain embodiments, provided with a discharge control system which is connected between the supply coupling, illustratively in the form of a hose or pipe coupled to the nozzle assembly, and the supply of fire suppressant material. The discharge control arrangement controls the delivery of the fire suppressant material in response to the magnitude of the supervisory electric current. Accordingly, the discharge control system has an electrical input terminal for receiving the supervisory electrical current, and an electrical threshold characteristic which determines inactivated and activated states of the discharge control; system. The particular state of the discharge control system is responsive to whether the magnitude of the supervisory current is above or below the electrical threshold characteristic. Consequently, the electrical threshold characteristic of the discharge control system is intermediate of the nominal supervisory electrical current value which flows through the electrical device, and a high supervisory electrical current value which flows through the short-circuit-like condition produced when the first and second conductors are brought into electrical communication with one another, as will be the case after the insulating sleeve has melted away.

In a specific embodiment of the invention, the system is provided with a valve having closed and opened states, which is connected to the supply coupling arrangement. An operator is coupled to the valve, which operator may be in the form of a lever having first and second positions which correspond to the closed and opened states, respectively. A biasing element, which may be in the form of a spring, applies a force to the operator which tends to urge same to the second position. However, a tension member which is coupled to the operator applies a force thereto in opposition to the biasing element, so as to maintain the operator in the first position. An activator, which may be in the form of a wire cutter, is responsive to the current flowing through the sensor wire and will cut the tension member so as to release same, in response to the sensor achieving an activated state.

In addition to the discharge of the fire suppressant material which will occur when the sensor enters the activated state, an alarm can be provided in certain embodiments to produce a perceptible indication when the first and second conductors are brought into electrical communication with one another. Any of several known alarm indicators can be employed in combination with the practice of the invention. Additionally, the system may be provided with a battery and battery charging circuitry, which will provide energy for maintaining the system in vigilance of the fire hazard, during periods that power from the mains is unavailable.

In accordance with a further system aspect of the invention, a system for producing an activation signal responsive to the presence of a fire which may occur within a protected region employs a hood which is arranged to overlie the protected region. The hood has a top wall, first and second side walls, and a front wall. As previously indicated, first and second conductors are arranged to carry a supervisory electrical signal, the first and second conductors being arranged and supported beneath the hood so as to be intermediate of the hood and the protected region. A conductor separation system having a predetermined heat response characteristic is provided, whereby the first and second conductors are maintained electrically insulated from one another when the ambient temperature is below a predetermined temperature value. The conductors are brought into electrical communication with one another when the predetermined temperature is exceeded. This results in a substantially short circuit, low impedance condition across the first and second conductors, and a corresponding increase in the magnitude of the supervisory electrical current, as previously mentioned. Also as indicated, an electrical device through which the supervisory electrical current is conducted can be provided, illustratively to produce a visual indication of the ready state of the system. Of course, the electrical impedance characteristic of the electrical device is substantially greater than the low impedance which results when the first and second conductors communicate with one another. The conductors are coupled to a current sensor which has an electrical input for receiving the supervisory electrical current. The sensor has activated and inactivated states responsive to an activation current threshold characteristic which is intermediate of a low supervisory electrical current value which flows through the electrical device when no fire is detected, and a high supervisory electrical current value which flows through the low impedance condition indicative of the presence of high heat.

This system aspect of the invention enjoys a number of the features of the aforementioned first system aspect, including the electrically insulating sleeve arranged to surround a portion of one of the conductors. The sleeve, as indicated, is formed of a material which melts when the predetermined temperature is exceeded.

In accordance with a method aspect of the invention, a process for detecting a predetermined heat condition within a predetermined zone includes the steps of defining a protected region within the predetermined zone by installing thereover a hood of predetermined dimensions; propagating a supervisory current through at least first and second conductors arranged in the vicinity of the hood, and within the defined protected region; and urging the first and second conductors into communication with one another when a temperature within the defined protected region exceeds a predetermined value, whereby the first and second conductors achieve a short-circuit-like condition.

In accordance with a specific embodiment of this method aspect of the invention, at least a portion of one of the first and second conductors is surrounded by an insulating material, and the step of urging includes the further step of melting the insulating material in response to a temperature associated with the heat condition exceeding a predetermined temperature. In such an embodiment, the first and second conductors are wound about one another, and there is further provided a step of detecting a change in the magnitude of the supervisory current in response to the first and second conductors being urged into communication with one another.

BRIEF DESCRIPTION OF THE DRAWING

Comprehension of the invention is facilitated by reading the following detailed description, in conjunction with the annexed drawing, in which.

DETAILED DESCRIPTION

Figure 1:
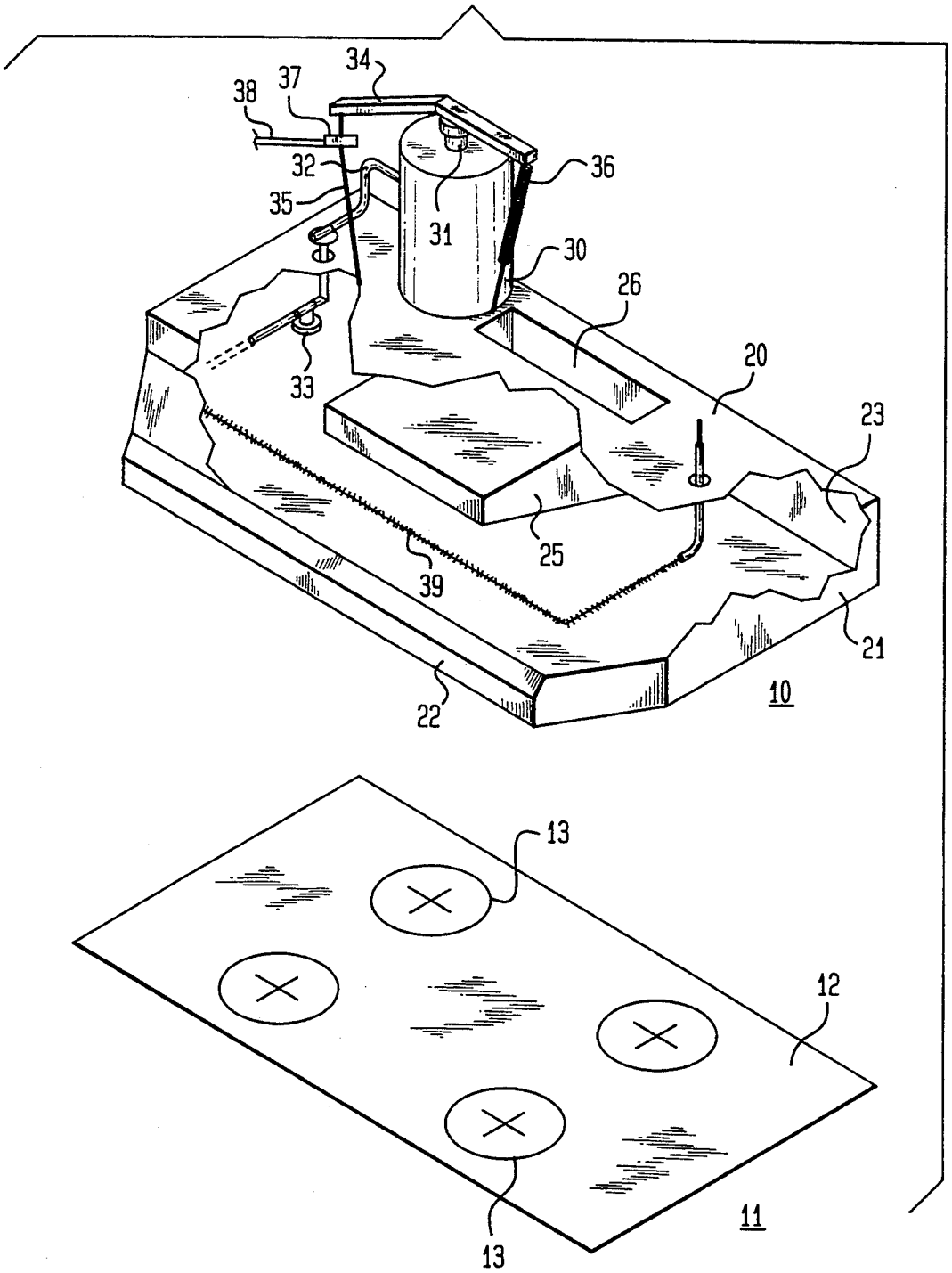
FIG. 1 is a partially cut-away isometric presentation of a specific illustrative embodiment of the invention.

FIG. 1 is a partially cut-away isometric presentation of a specific embodiment of the invention. The figure shows a residential-style range hood 10 which is arranged to overlie, in this specific embodiment, a range 11 which has a cooking surface 12 and a plurality of burners 13.

Range hood 10 is provided, in this specific illustrative embodiment, with a top wall 20, side walls 21 (only one of which is shown in the figure), a front wall 22, and a back wall 23. This embodiment of the range hood also contains a filter housing 25 which is coupled to a duct outlet 26.

A chemical agent supply tank 30 is, in this specific embodiment, disposed on top of the range hood, illustratively on top wall 20, and is provided with a pressurized supply of fire suppressant material (not shown). The supply tank is coupled via a discharge valve 31 to a system of hoses 32 which couple the supply tank to a nozzle 33. Nozzle 33 is, in this specific illustrative embodiment of the invention, one of a plurality of nozzles. The discharge valve is maintained in a closed state by an operator lever 34 which is maintained in the position shown in the figure by operation of a wire 35 which is maintained in tension. An electrically actuated wire cutter 37 is arranged to surround wire 35. The wire cutter is provided with a pair of electrical leads 38 via which is supplied the electrical energy required to actuate the wire cutter. Upon actuation of wire cutter 37, as will be described hereinbelow, wire 35 is severed, permitting operator lever 34 to be urged upwardly, in this embodiment, by operation of a tension spring 36. The upward motion of the operator lever causes the discharge valve to be opened, thereby releasing the fire suppressant contents of the supply tank through hose 32, whereby it is expelled from nozzle 33. Nozzle 33, as shown, is directed to cooking range 11, so as to suppress a fire started thereon.

In operation, range hood 10 detects the presence of excessive heat thereunder, such as would be caused by a fire on cooking range 11, by means of a continuous sensor which is formed of a pair of twisted sensor wires 39. The twisted sensor wires are secured to the underside of the hood, illustratively one inch below the underside of top wall 20, or attached directly to the underside of top wall 20. In this embodiment, two sensor wires are employed (not specifically shown), and are placed from the rear of the hood toward the front wall. In one practicable embodiment, the sensor wires are placed approximately one inch from the side walls and parallel thereto. In addition, the wires are placed across the front of filter housing 25 at approximately one inch from the front thereof. The two sensor wires are coupled to connector wires which are coupled to a control panel (not shown in this figure) as will be described below.

As will be described hereinbelow, with respect to FIG. 2, a supervisory current is conducted through the twisted sensor wires and a termination impedance, which may be in the form of a sensor circuit, a lamp, such as a LED, or a termination resistor, as will be discussed herein. Each of the sensor wires in this embodiment is covered with a plastic insulation (not shown) which is characterized by a predetermined melting point. Thus, at the predetermined melting point, which may be 280° F. in some embodiments, the insulation melts so as to permit the wires to communicate electrically with one another. In one specific embodiment of the invention, twisted sensor wires 39 constitute a length of wire designated as type WPP wire rated at 280° F. Such wire is manufactured by Protectowire, Inc.

In this specific illustrative embodiment of the invention, sensor wires 39 are, in a first portion 40, each covered by a respective insulating sleeve 41. In this portion, the conductors are separated by at least two thicknesses of insulator, and as stated, the insulating sleeves will melt away upon the exposure to a predetermined temperature level, permitting the wires themselves to communicate electrically with one another. In other embodiments, and as shown in portion 42 of sensor wires 39, only one of the wires is covered with the insulating sleeve. The second wire is wrapped around the insulating sleeve, and will communicate electrically with the wire within the sleeve when the insulating sleeve is melted away in response to the elevated temperature. In such an embodiment, a single insulating sleeve serves as the conductor separation means. Of course, the wire sensor need not be in both forms. i.e., portions 40 and 42, but may exclusively be one or the other.

Figure 2:
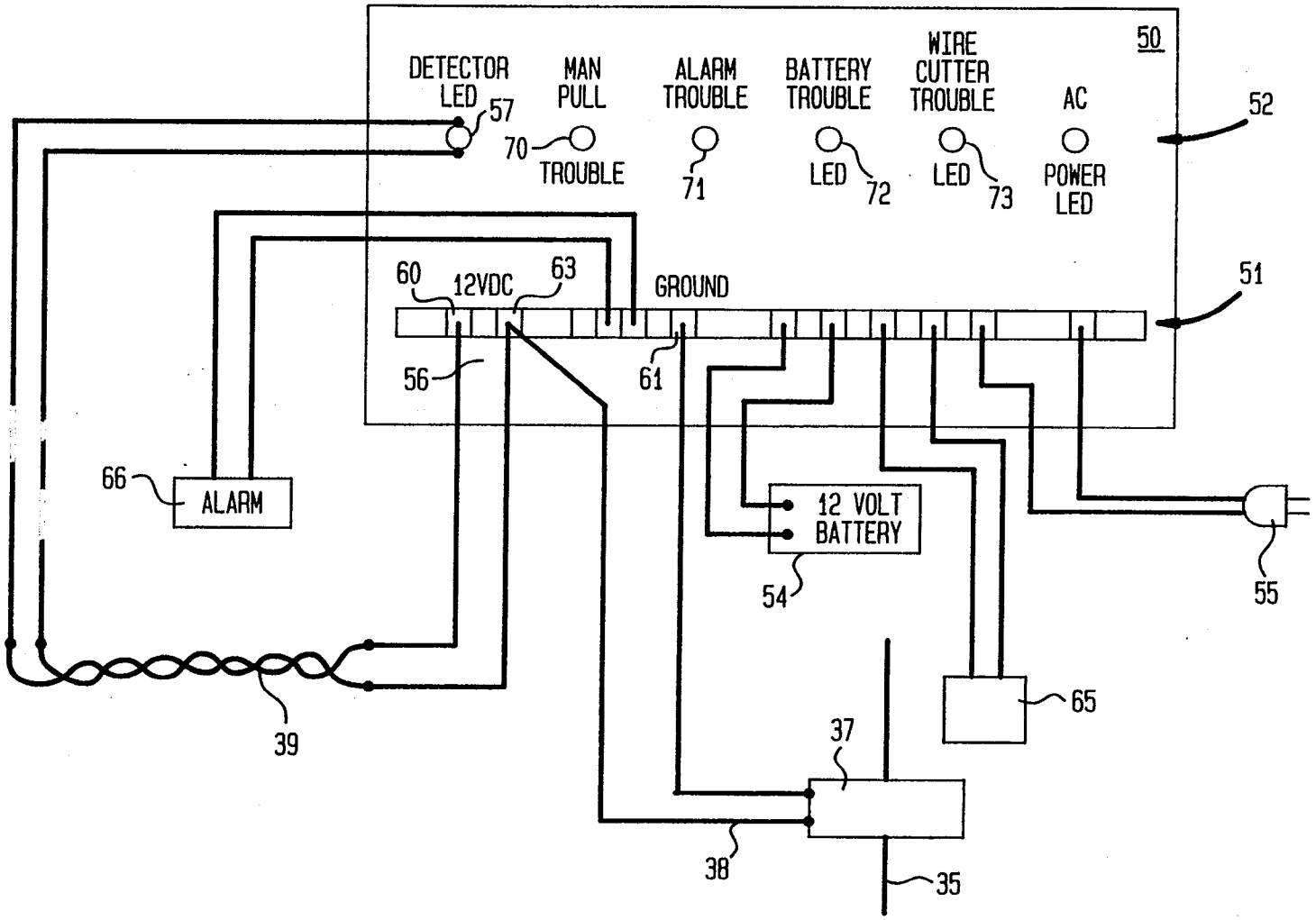
FIG. 2 is a schematic representation of a control panel with electrical inputs for various features of the invention.

FIG. 2 is a simplified schematic representation of a specific illustrative embodiment of an indicator and interconnection panel which is useful in the practice of a specific embodiment of the invention. Elements of structure which are identical or bear analogous correspondence to the elements of structure described hereinabove with respect to FIG. 1, are similarly designated. This figure shows a schematic representation of a panel 50 having a plurality of electrical terminals 51 associated therewith, and a plurality of indicator lights 52. Of course, in the practice of the invention, electrical terminals 51 need not necessarily be visible when a user of the system is observing indicator lights 52.

System power is obtained from a 12 volt direct current supply (not shown) which receives its power from the 120 volt mains at input 55. In this specific embodiment, the power supply will maintain the battery, illustratively 12 volt battery 54, in a charged state. The use of battery 54 provides the significant advantage of supplying power to the system during times that power from the mains (not shown) is unavailable. However, other embodiments of the invention might rely entirely on line power, without battery 54.

Electrical energy in the form of 12 volts DC is available at conductors 56, whereby the supervisory current described hereinabove is conducted through twisted sensor wires 39, and through a detector light emitting diode 57. In operation, the present specific illustrative embodiment employs a series electrical circuit which includes the twisted sensor wires, detector LED 57 and wire cutter 37. More specifically, 12 volts DC is available at terminal 60 with respect to ground at terminal 61. The current flows from terminal 60, through one of the twisted sensor wires 39, through detector LED 57, through the other of twisted sensor wires 39, to terminal 63, through lead 38, through wire cutter 37, and to ground at terminal 61. The current through this loop is controlled by the impedance of detector LED 57, which may have a series resistor associated therewith. The current is therefore limited to a level below the actuation level of wire cutter 37. Viewed another way, most of the voltage is dropped across detector LED 57 and its optional associated resistor (not shown), and only a small voltage is produced across the wire cutter. However, in the event of a thermal hazard sufficient to melt the plastic insulation surrounding the sensor wires, the sensor wires will communicate electrically with one another, effectively causing a low impedance condition which bypasses LED 57. Thus, a full 12 volts is applied across the wire cutter, which is then actuated to cut tension wire 35. As previously described, the cutting of the tension wire will permit the operator lever 34 to be moved such that discharge valve 31 is opened, releasing the fire suppressant fluid.

FIG. 2 further shows a remote manual electric release 65 which is useful to permit the system to be actuated from a remote location. In some embodiments, manual electrical release 65 may be a contact switch which is electrically coupled, by circuitry not shown, across terminals 60 and 63. Thus, this device serves to apply the full 12 volts to the wire cutter, thereby actuating same. In addition, also by means of circuitry which is not shown in this figure, an alarm 66 is actuated upon activation of the system for the purpose of providing a perceptible signal indicative of a fire. Alarm 66 may be in the form of a strobe light, a siren, or a horn. Persons of skill in the art would understand how to configure the circuitry which is mentioned herein, but not specifically disclosed. Such circuitry could include the circuitry which monitors the trouble indicators 70 to 73, which indicate failure conditions in the manual electric release 65, alarm 66, battery 54, and wire cutter 37, respectively.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A system for producing an activation signal responsive to the presence of a fire which may occur within a protected region, the system comprising:

hood means arranged to overlie the protected region, said hood means having a top wall, first and second side walls, and a front wall;

first and second conductors for carrying a supervisory electrical current, said first and second conductors being arranged and supported beneath said hood means so as to be intermediate of said hood means and the protected region;

conductor separation means having a predetermined heat response characteristic whereby said first and second conductors are maintained electrically insulated from one another below a predetermined temperature, and are brought into electrical communication with one another when said predetermined temperature is exceeded to produce a substantially short-circuit impedance across said first and second conductors and a corresponding increase in the magnitude of said supervisory electrical current;

an electrical device through which said supervisory electrical current is propagated, said electrical device having an electrical impedance characteristic which is substantially greater than said substantially short-circuit impedance; and current sensor means having an electrical input for receiving the supervisory electrical current, said sensor means having inactivated and activated states responsive to an activation current threshold characteristic which is intermediate of a low supervisory electrical current magnitude which flows through said electrical device, and a high supervisory electrical current magnitude which flows through a low impedance condition produced when said first and second conductors are brought into electrical communication with one another.

2. The system of claim 1 wherein said conductor separation means comprises an electrically insulating sleeve arranged to surround at least a portion of one of said first and second conductors, said electrically insulating sleeve being formed of a material which melts when said predetermined temperature is exceeded.

3. The system of claim 2 wherein said first and second conductors are both arranged to communicate with said electrically insulating sleeve on opposite sides thereof.

4. The system of claim 2 wherein each of said conductors is provided with an electrically insulating sleeve, said respective electrically insulating sleeves being arranged to communicate with one another.

5. The system of claim 4 wherein said electrically insulating sleeves with their respectively associated ones of their first and second conductors therein are wound about one another for at least a portion of their respective lengths.

6. A method of detecting a predetermined heat condition within a predetermined zone, the method comprising the steps of:

defining a protected region within said predetermined zone by installing thereover a hood of predetermined dimensions;

propagating a supervisory current through at least first and second conductors arranged in the vicinity of said hood, and within the defined protected region;

urging said first and second conductors into electrical communication with one another when a temperature within the defined protected region exceeds a predetermined temperature, whereby said first and second conductors achieve a low impedance condition; and detecting a change in the magnitude of said supervisory current in response to said first and second conductors being urged into electrical communication with one another.

7. The method of claim 6 wherein there is further provided the step of surrounding at least a portion of at least one of said first and second conductors with an insulating material, and said step of urging comprises the further step of melting said insulating material, in response to a temperature associated with the heat condition exceeding a predetermined temperature.

8. The method of claim 7 wherein there is further provided the step of arranging said first and second conductors to be wound about one another, whereby upon melting of said insulating material, said first and second conductors are urged into communication with one another.

* * * * *